US010352309B2

(12) United States Patent
Sato et al.

(10) Patent No.: US 10,352,309 B2
(45) Date of Patent: Jul. 16, 2019

(54) FLUID PRESSURE PRODUCING METHOD AND FLUID PRESSURE PRODUCING DEVICE

(71) Applicant: SUGINO MACHINE LIMITED, Uozu, Toyama Prefecture (JP)

(72) Inventors: Sho Sato, Toyama (JP); Shin Isikura, Toyama (JP)

(73) Assignee: SUGINO MACHINE LIMITED, Uozu, Toyama (JP)

( * ) Notice: Subject to any disclaimer, the term of this patent is extended or adjusted under 35 U.S.C. 154(b) by 215 days.

(21) Appl. No.: 15/266,718

(22) Filed: Sep. 15, 2016

(65) Prior Publication Data

US 2017/0089328 A1 Mar. 30, 2017

(30) Foreign Application Priority Data

Sep. 25, 2015 (JP) ..... 2015-188262

(51) Int. Cl.
*F04B 9/103* (2006.01)
*F04B 53/14* (2006.01)
(Continued)

(52) U.S. Cl.
CPC ..... *F04B 9/109* (2013.01); *F04B 5/02* (2013.01); *F04B 9/103* (2013.01); *F04B 9/113* (2013.01);
(Continued)

(58) Field of Classification Search
CPC .. F04B 9/103; F04B 9/02; F04B 9/113; F04B 11/008; F04B 19/22; F04B 23/06;
(Continued)

(56) References Cited

U.S. PATENT DOCUMENTS 5,927,329 A * 7/1999 Yie ..... A62C 31/02 137/624.13
6,135,724 A * 10/2000 Yoder ..... F04B 9/113 222/63

(Continued)

FOREIGN PATENT DOCUMENTS

EP 0050319 A2 4/1982
EP 2998579 A2 3/2016

(Continued)

OTHER PUBLICATIONS

Extended European Search Report dated Jan. 26, 2017 from European Patent Office for an corresponding European patent application No. 16189682.4.

(Continued)

*Primary Examiner* — Dominick L Plakkoottam
*Assistant Examiner* — Connor J Tremarche
(74) *Attorney, Agent, or Firm* — United IP Counselors, LLC

(57) ABSTRACT

A fluid pressure producing method reduces fluctuations in the pressure of a fluid pressurized using a plunger driven by applying the pressure of a working medium to a double-acting piston. The method includes switching a moving direction of the piston when detecting the piston reaching a movement end, operating the working medium pump to discharge the working medium at a maximum flow rate while the load is less than the load limit after the moving direction of the piston is switched, and detecting a pressure of the fluid and feeding back the detected pressure of the fluid and performing feedback control of the pressure of the fluid to eliminate a difference between the pressure of the fluid and a target pressure of the fluid.

14 Claims, 6 Drawing Sheets

(51) Int. Cl.

| | |
|---|---|
| ***F04B 51/00*** | (2006.01) |
| ***F04B 19/22*** | (2006.01) |
| ***F04B 49/12*** | (2006.01) |
| ***F04B 9/109*** | (2006.01) |
| ***F04B 5/02*** | (2006.01) |
| ***F04B 9/113*** | (2006.01) |
| ***F04B 11/00*** | (2006.01) |
| ***F04B 23/06*** | (2006.01) |
| ***F04B 49/02*** | (2006.01) |
| ***F04B 49/06*** | (2006.01) |
| ***F04B 49/08*** | (2006.01) |
| *B26F 3/00* | (2006.01) |

(52) U.S. Cl.
CPC ..... *F04B 11/0008* (2013.01); *F04B 19/22* (2013.01); *F04B 23/06* (2013.01); *F04B 49/022* (2013.01); *F04B 49/065* (2013.01); *F04B 49/08* (2013.01); *F04B 49/12* (2013.01); *F04B 51/00* (2013.01); *F04B 53/14* (2013.01); *B26F 3/004* (2013.01)

(58) Field of Classification Search
CPC ..... F04B 49/022; F04B 49/065; F04B 49/08; F04B 49/12; F04B 51/00; F04B 53/14; B26F 3/004
USPC ..... 417/46
See application file for complete search history.

(56) References Cited

U.S. PATENT DOCUMENTS

2011/0148096 A1* 6/2011 Engle ..... G01K 1/14 285/93
2013/0121852 A1* 5/2013 Joung ..... E02F 9/2214 417/213
2013/0167951 A1* 7/2013 Trieb ..... F04B 17/03 137/492
2016/0084241 A1* 3/2016 Sato ..... F04B 1/2078 417/222.1
2016/0108939 A1* 4/2016 Trieb ..... F04B 17/03 60/545

FOREIGN PATENT DOCUMENTS

JP 3822362 B 9/2006
JP 2013-513069 A 4/2013

OTHER PUBLICATIONS

Office Action dated Jun. 27, 2018 in a corresponding Chinese patent application No. 201610843138.7.
Office Action dated Jun. 19, 2018 in a corresponding Japanese patent application No. 2015-188262.

* cited by examiner

FLUID PRESSURE PRODUCING METHOD AND FLUID PRESSURE PRODUCING DEVICE

CROSS-REFERENCE TO RELATED APPLICATIONS

This application claims the benefit of priority to Japanese Patent Application No. 2015-188262, filed on Sep. 25, 2015, the entire contents of which are hereby incorporated by reference.

BACKGROUND

1. Technical Field

The present invention relates to a fluid pressure producing method and a fluid pressure producing device for pressuring a fluid by applying the pressure of a working medium to a double-acting piston and driving a plunger.

2. Description of the Background

Fluid pressure producing devices known in the art pressurize a fluid by applying the pressure of a working medium to a double-acting piston and thus driving a plunger. Such fluid pressure producing devices use the pressure of the working medium to pressurize the fluid. The discharge pressure of the fluid can have large pulsations due to the discharge performance of the working medium pump, response delays of the direction control valve, and compressibility of the working medium and the fluid.

Waterjet technology uses a jet of ultrahigh pressure fluid discharged from a fluid pressure producing device in cutting or other machining processes. The fluid pressure pulsations can cause flow rate pulsations, which can cause a disturbance in the jet. Techniques have thus been developed to control the fluid pressure. One such technique known in the art directly drives a plunger with a servo motor and maintains the constant moving speed of the plunger to shorten the time taken for switching the moving direction of the plunger (Japanese Patent No. 3822362, or hereafter Patent Literature 1).

BRIEF SUMMARY

A liquid pressurizing device described in Patent Literature 1 controls a plunger directly driven using a servo motor and a ball screw mechanism. The position and the speed of the plunger are determined directly based on the rotational angle of the servo motor. The technique described in Patent Literature 1 is not usable for a fluid pressure producing device that pressurizes a fluid by applying the pressure of a working medium to a double-acting piston and driving a plunger.

One or more aspects of the present invention are directed to a fluid pressure producing method and a fluid pressure producing device that reduce fluctuations in the pressure of a fluid pressurized by applying the pressure of a working medium to a double-acting piston and driving a plunger.

A fluid pressure producing method for pressuring a fluid using a plunger driven by operating a double-acting piston with a pressure of a working medium produced from a working medium pump, the method comprising:

switching a moving direction of the piston when detecting the piston reaching a movement end;

detecting a load of the working medium pump and determining whether the detected load is not less than a load limit;

operating the working medium pump to discharge the working medium at a maximum flow rate while the load is less than the load limit after the moving direction of the piston is switched; and detecting a pressure of the fluid and feeding back the detected pressure of the fluid and performing feedback control of the pressure of the fluid to eliminate a difference between the pressure of the fluid and a target pressure of the fluid.

A fluid pressure producing device comprising:

a working medium pump configured to pressurize a working medium;

a piston configured to reciprocate in a first cylinder with the pressurized working medium;

a plunger connected to the piston and configured to reciprocate in a second cylinder to pressurize the fluid;

an end detector configured to detect the piston reaching a movement end;

a fluid pressure detector configured to detect a pressure of the fluid; and a controller including a moving direction control unit configured to determine a moving direction of the piston based on a result of detection performed by the end detector, a load determination unit configured to determine whether a load of the working medium pump is not less than a load limit, a maximum operation unit configured to operate the working medium pump to discharge the working medium at a maximum flow rate while the load determination unit determines that the load is less than the load limit after the moving direction control unit switches the moving direction of the piston, and a fluid pressure feedback control unit configured to feed back the pressure of the fluid detected by the fluid pressure detector, and perform feedback control of the pressure of the fluid to eliminate a difference between the pressure of the fluid and a target pressure of the fluid.

One or more embodiments of the present invention reduce fluctuations in the pressure of a fluid pressurized using a plunger driven by applying the pressure of a working medium to a double-acting piston.

DETAILED DESCRIPTION

First Embodiment

Figure 1:
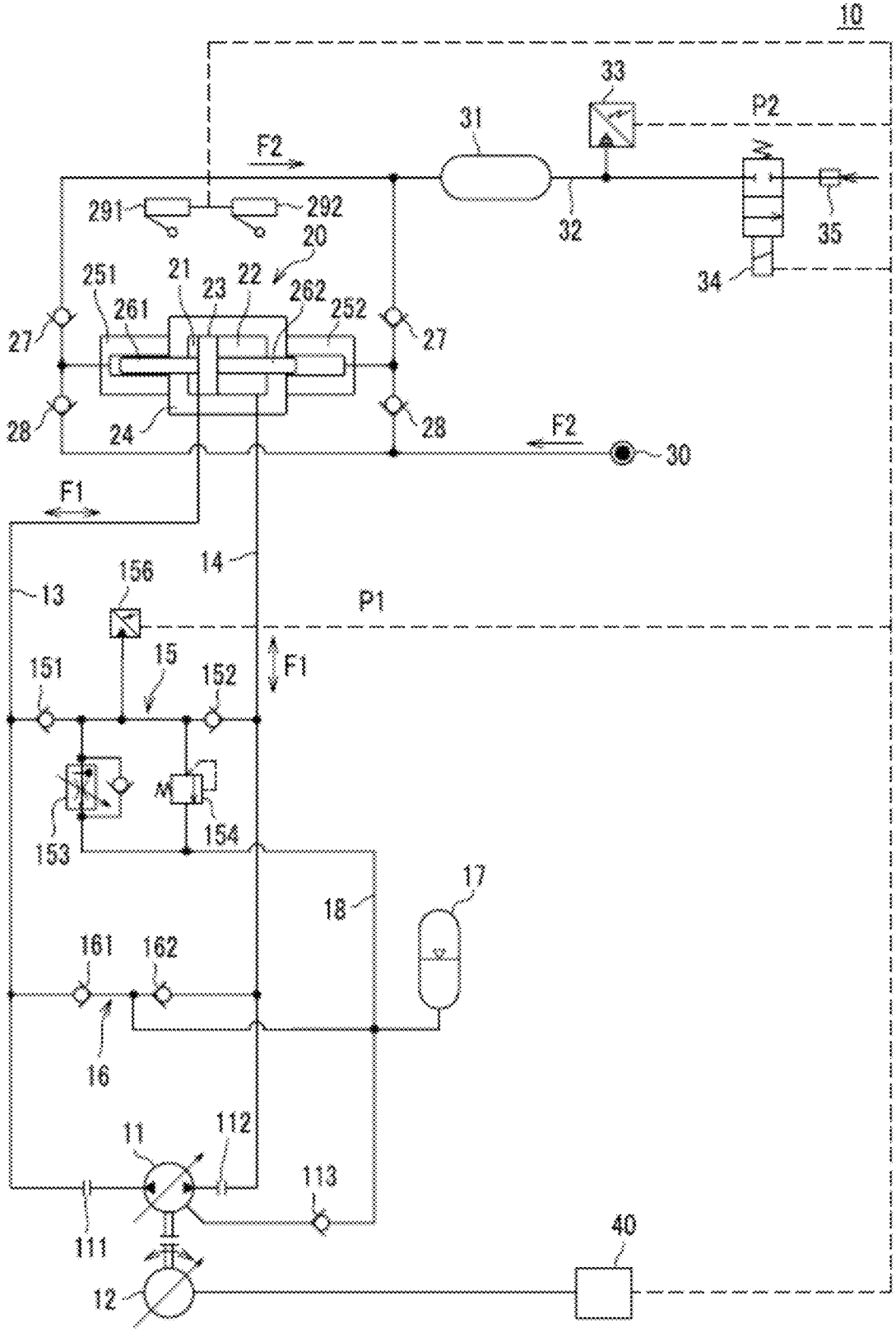
FIG. 1 is a schematic diagram of a fluid pressure producing device according to a first embodiment.

A fluid pressure producing device 10 according to a first embodiment will now be described with reference to FIG. 1. A working medium F1 is a hydraulic oil. A fluid F2 to be pressurized is water. The fluid F2 to be pressurized is hereafter simply referred to as the fluid F2. The fluid pressure producing device 10 includes a pressure intensifier 20, and a working medium pump 11 for a closed circuit. The pressure intensifier 20 includes a double-acting piston 23, and plungers 261 and 262. The fluid pressure producing device 10 operates the piston 23 using the pressure of the working medium F1 produced by the working medium pump 11. The plungers 261 and 262 pressurize the fluid F2. The fluid pressure producing device 10 can be used for waterjet cutting using ultrahigh pressure water that is jetted continuously.

The working medium pump 11 includes two inlet-outlet ports 111 and 112. The working medium pump 11 is a variable displacement pump, which can vary its displacement. The working medium pump 11 is driven by a motor 12. The motor 12 is, for example, a servo motor. The working medium pump 11 has internal leakage. A leakage circuit 113 drains internally leaking hydraulic oil. The working medium pump 11 may be, for example, a variable displacement swashplate pump or a variable displacement bent axis pump.

The working medium pump 11 may not be a variable displacement pump, and may be a fixed displacement pump, such as a fixed displacement swashplate pump, a fixed displacement bent axis pump, a gear pump, a vane pump, or any other displacement pump. The motor 12 may be a permanent magnet synchronous motor and a rotary encoder, in combination with a rotary sensor such as a magnetic rotary sensor.

The pressure intensifier 20 pressurizes the fluid F2 by increasing the pressure of the working medium F1 in accordance with an intensification ratio R, which is the ratio of an area of the piston 23 for receiving the pressure of the working medium F1 to an area of the plungers 261 and 262 for receiving the pressure of the fluid F2. The piston 23 reciprocates in a drive cylinder (first cylinder) 24. The piston 23 separates the internal space of the drive cylinder 24 into a first compartment 21 and a second compartment 22. The plungers 261 and 262, which reciprocate in ultrahigh pressure cylinders (second cylinders) 251 and 252, are arranged on the piston 23.

The pressure intensifier 20 includes end detectors 291 and 292. The end detectors 291 and 292 each detect the piston 23 positioned at a corresponding end of its movement (movement end) in the drive cylinder 24, and output an end detection signal. The end detectors 291 and 292 are, for example, switches such as limit switches, proximity switches, or other switches with electrical contacts. The end detectors 291 and 292 are, for example, normally open contact switches or normally closed contact switches.

A first channel 13 connects the first compartment 21 and the inlet-outlet port 111. A second channel 14 connects the second compartment 22 and the inlet-outlet port 112. When the piston 23 moves to the right in FIG. 1, the working medium pump 11 sucks the working medium F1 from the second compartment 22 through the second channel 14, and discharges the medium into the first compartment 21 through the first channel 13. When the piston 23 moves to the left in FIG. 1, the working medium pump 11 sucks the working medium F1 from the first compartment 21 and discharges the medium into the second compartment 22 through the second channel 14.

A selector 15 connects the first channel 13 and the second channel 14 via a pair of check valves 151 and 152. The selector 15 includes a pressure detector 156. The pressure detector 156 detects a pressure P1, which is the higher one of the pressure in the first channel 13 and the pressure in the second channel 14.

The selector 15 connects either the first channel 13 or the second channel 14 having the higher pressure to a collector 18. The collector 18 includes a relief valve 154 and a restrictor 153. The collector 18 collects excess working medium F1 from the selector 15 into a tank 17.

A supply circuit 16 connects the first channel 13 or the second channel 14 to the tank 17 via a pair of check valves 161 and 162. The supply circuit 16 supplies the working medium F1 to the first channel 13 or the second channel 14 having the lower pressure.

A source 30 of the fluid F2 communicates with the ultrahigh pressure cylinders 251 and 252 via suction valves 28. The ultrahigh pressure cylinders 251 and 252 communicate with an accumulator 31 via discharge valves 27. A pipe 32 connects the accumulator 31 and a nozzle 35 having a nozzle hole via an injection valve 34. The pipe 32 includes a pressure detector 33, which detects and outputs the pressure of the fluid F2.

When the piston 23 moves to the left, the plunger 261 displaces and pressurizes the fluid F2. As a result, the discharge valve 27 is open to discharge the fluid F2. The plunger 262 moves to the left in the ultrahigh pressure cylinder 252. As a result, the suction valve 28 is open to suck the fluid F2. When the piston 23 moves to the right, the operation reverse to this operation is performed.

Figure 2:
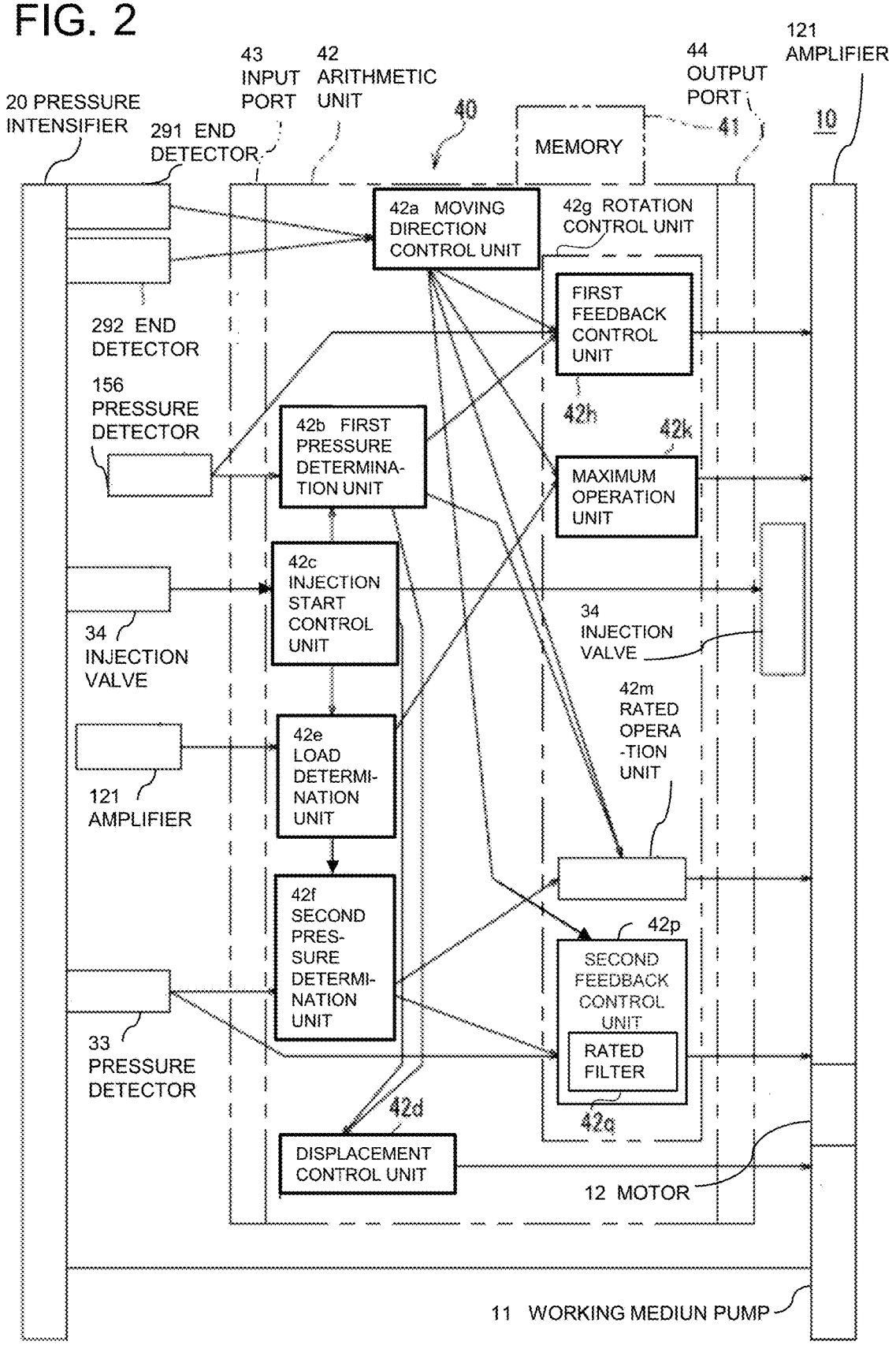
FIG. 2 is a functional block diagram of a fluid pressure producing device according to the first embodiment.

The components and the functions of a controller 40 will now be described with reference to FIG. 2. The controller 40 includes a memory 41, an arithmetic unit 42, an input port 43, and an output port 44, which are connected to one another with a bus (not shown).

The memory 41 stores programs for enabling the functions of the arithmetic unit 42, and data for enabling the functions of the arithmetic unit 42. The programs and the data are input from an input device (not shown), such as a touch panel, a pointing device, or a keyboard, into the memory 41 through the input port 43.

An amplifier 121 is connected to the motor 12 to allow its output to the motor 12. The motor 12 rotates the working medium pump 11. Under the pressure P1, the pressure intensifier 20 operates in the manner described above. The operating status of the fluid pressure producing device 10 is input into the input port 43. The arithmetic unit 42 calculates the rotational speed and the displacement of the working medium pump 11. The output port 44 outputs the calculation results from the arithmetic unit 42 to the amplifier 121, the injection valve 34, and the working medium pump 11.

The arithmetic unit 42 includes a moving direction control unit 42*a*, a first pressure determination unit 42*b*, an injection start control unit 42*c*, a load determination unit 42*e*, a second pressure determination unit (pressure determination unit) 42*f*, and a displacement control unit 42*d*.

An end detection signal from the end detectors 291 and 292 is input into the moving direction control unit 42*a*.

When receiving an end detection signal, the moving direction control unit 42*a* switches the moving direction of the piston 23 and the plungers 261 and 262 (hereafter, the moving direction of the piston 23), or the discharge direction of the working medium pump 11. When the working medium pump 11 is a reversible pump, the discharge direction is determined by the rotating direction of the motor 12. The moving direction control unit 42*a* outputs a moving direction signal indicating the moving direction of the piston 23. For example, the moving direction control unit 42*a* outputs a signal indicating 1 when the piston 23 moves to the right, and outputs a signal indicating 0 when the piston 23 moves to the left.

For the working medium pump 11 that is a variable displacement swashplate pump with a reversible tilt angle, the discharge direction is determined based on whether the tilt angle is positive or negative. The working medium pump 11 rotates in one direction. The moving direction control unit 42*a* outputs a moving direction signal to the displacement control unit 42*d*. The moving direction control unit 42*a* outputs no moving direction signal to a first feedback control unit 42*h*, a maximum operation unit 42*k*, a rated operation unit 42*m*, and a second feedback control unit 42*p*.

The moving direction control unit 42*a* retains the moving direction signal after injection of the fluid F2 is stopped. When injection of the fluid F2 is resumed, the moving direction control unit 42*a* outputs the retained moving direction signal.

The injection start control unit 42*c* controls the injection valve 34. To start injection, the injection start control unit 42*c* outputs a valve opening instruction to the injection valve 34 through the output port 44. The injection start control unit 42*c* also receives a valve open signal indicating that the injection valve 34 is open from the injection valve 34 through the input port 43. When receiving the valve open signal from the injection valve 34, the injection start control unit 42*c* outputs an injection signal to the first pressure determination unit 42*b*, the load determination unit 42*e*, and the displacement control unit 42*d*. For example, the injection signal is set to 1 when the fluid F2 is to be injected, and is set to 0 when the injection is to be stopped.

The first pressure determination unit 42*b* operates during the injection stop period, or in other words when no valve open signal is received. The first pressure determination unit 42*b* receives a signal indicating the pressure P1 from the pressure detector 156. The first pressure determination unit 42*b* determines whether the pressure P1 is not less than a first threshold pressure P1T, which is slightly lower than a target pressure P1com. For example, the first pressure determination signal is set to 1 when the pressure P1 is not less than the first threshold pressure P1T, and is set to 0 when the pressure P1 is less than the first threshold pressure P1T. The first pressure determination unit 42*b* outputs the first pressure determination signal to the first feedback control unit (working medium pressure feedback control unit) 42*h* and the rated operation unit 42*m*.

The first pressure determination unit 42*b* may determine whether the pressure P1 exceeds the first threshold pressure P1T. In this case, the first pressure determination signal is set to 1 when the pressure P1 exceeds the first threshold pressure P1T, and is set to 0 when the pressure P1 is not more than the first threshold pressure P1T.

The load determination unit 42*e* operates during injection, or in other words when the injection signal indicates 1. The load determination unit 42*e* receives a signal indicating a load acting on the working medium pump 11 from the amplifier 121 through the input port 43. The load in the present embodiment is a rotational torque Tr of the motor 12. The rotational torque of the input axis in the working medium pump can be measured easily. The load determination unit 42*e* determines whether the rotational torque Tr is not less than a torque limit TrL. The load determination unit 42*e* outputs load determination information to the second pressure determination unit 42*f* and the maximum operation unit 42*k*. For example, the load determination information indicates 1 when the load is not less than the load limit, and indicates 0 when the load is less than the load limit.

When no decelerator is arranged between the output axis of the motor 12 and the input axis of the working medium pump 11, the rotational torque Tr of the motor 12 is equal to the rotational torque of the input axis in the working medium pump 11. When a decelerator is arranged between the output axis of the motor 12 and the input axis of the working medium pump 11, the load limit is set based on the deceleration of the decelerator. More specifically, the rotational torque Tr of the motor 12 is multiplied by the deceleration to calculate the input torque of the working medium pump 11.

The second pressure determination unit 42*f* receives a signal indicating a pressure P2 of the fluid F2 from the pressure detector 33. The second pressure determination unit 42*f* determines whether the pressure P2 is not less than a second threshold pressure P2T. The second threshold pressure P2T is set slightly lower than a preset pressure P0, which is a target pressure P2com of the fluid F2. The second threshold pressure P2T is a value obtained by subtracting a threshold T2 from the preset pressure P0. The threshold T2 is set based on whether feedback control is to be started. The threshold T2 is set to allow the pressure to promptly approach the preset pressure P0 after the feedback control is started without causing an overshoot in the pressure P2. The threshold T2 is set based on, for example, a steady-state deviation offset in proportional feedback control. The second pressure determination unit 42*f* outputs a second pressure determination signal to the rated operation unit 42*m* and the second feedback control unit (fluid pressure feedback control unit) 42*p*. For example, the second pressure determination signal is set to 1 when the pressure P2 is not less than the second threshold pressure P2T, and is set to 0 when the pressure P2 is less than the second threshold pressure P2T.

In the present embodiment, the working medium F1 is discharged from the working medium pump 11 at a rated flow rate after the piston speed increases and reaches or exceeds the load limit. Also, feedback control is performed after the pressure of the fluid F2 reaches a pressure slightly lower than the target pressure. Feedback control normally involves response delays. In the present embodiment, the working medium is discharged from the working medium pump at a rated flow rate before the fluid pressure reaches the pressure slightly lower than the target pressure. This eliminates response delays caused by the feedback control. The feedback control is started after the pressure of the fluid F2 increases to around the target pressure. This allows the pressure of the fluid to promptly reach its target pressure without an overshoot caused by the feedback control.

The second threshold pressure P2T is, for example, 80% to 97% of the preset pressure P0, and may preferably be 85% to 95%.

The second pressure determination unit 42*f* may be eliminated. In this case, the load determination unit 42*e* provides a feedback control start instruction to the second feedback control unit 42*p* when the load of the working medium pump 11 is not less than the load limit.

When the second pressure determination unit 42*f* is eliminated, a rated filter 42*q* (described later) may preferably be added.

The second pressure determination unit 42*f* may determine whether the pressure P2 exceeds the second threshold pressure P2T. In this case, the second pressure determination signal is set to 1 when the pressure P2 exceeds the second threshold pressure P2T, and is set to 0 when the pressure P2 is not more than the second threshold pressure P2T.

The displacement control unit 42*d* is arranged for the working medium pump 11 that is a variable displacement pump. The displacement control unit 42*d* determines and controls the displacement of the working medium pump 11. The displacement control unit 42*d* receives an injection signal from the injection start control unit 42*c* and a first pressure determination signal from the first pressure determination unit 42*b*. When the injection signal indicates 1, the displacement control unit 42*d* maximizes the displacement. When the injection signal indicates 0 (when the injection is stopped), the displacement control unit 42*d* minimizes the displacement. More specifically, the displacement control unit 42*d* outputs a signal indicating a tilt angle for the working medium pump 11 that is a variable displacement swashplate pump.

The displacement of the variable displacement pump is minimized during the injection stop period. As a result, the pressure P2 of the fluid F2 decreases to a pressure slightly lower than the pressure during injection. This is seemingly because a response to the change in the displacement occurs faster than a response to the stop of the pressure intensifier 20. When the injection is resumed, the pressure recovers promptly as the pressure intensifier 20 is driven. When the pressure P2 of the fluid F2 produced in the fluid pressure producing device 10 exceeds 500 MPa, the excessively high pressure P2 increases an internal stress in the fluid pressure producing device 10. Reducing such internal stress greatly improves the durability of the fluid pressure producing device 10. The fluid pressure producing device 10 according to the present embodiment thus greatly lengthens the maintenance interval.

The piston 23 does not move during the injection stop period. The working medium pump does not supply the working medium F1 to the cylinders. The displacement is maximized during injection of the fluid F2 and is minimized during the injection stop period to change the discharge performance of the working medium pump in an appropriate manner. This increases the responsiveness of the pressure and the flow rate of the working medium F1 to the operation of the working medium pump 11 and stabilizes the pressure waveform of the fluid F2, and also reduces power consumption.

The rotation control unit 42*g* includes the first feedback control unit 42*h*, the maximum operation unit 42*k*, the rated operation unit 42*m*, and the second feedback control unit 42*p*.

The first feedback control unit 42*h* operates during the injection stop period. The first feedback control unit 42*h* controls the rotational speed of the motor 12 based on the moving direction signal received from the moving direction control unit 42*a*, the first pressure determination signal received from the first pressure determination unit 42*b*, and the pressure P1 received from the pressure detector 156. The first feedback control unit 42*h* outputs a rotational speed n of the motor 12 to the amplifier 121.

The first feedback control unit 42*h* feeds back the pressure P1, and controls the working medium pump 11 to eliminate the difference between the target pressure P1com and the pressure P1 of the working medium F1. The feedback control may be proportional integral differential (PID) control, simple adaptive control, robust control, or optimal control.

The target pressure P1com may be a logical pressure PL obtained by dividing the preset pressure P0, which is the target pressure P2com of the fluid F2 during injection, by the intensification ratio R.

The target pressure P1com may preferably be a value obtained by subtracting a threshold T1 for the pressure increase of the fluid F2 during the injection stop period from the logical pressure PL. In particular, when the working medium pump 11 is a variable displacement pump and the controller 40 includes the displacement control unit 42*d*, the target pressure P1com is set to a pressure slightly lower than the logical pressure PL to allow optimum control of the pressure P1 and to reduce power consumption.

When the fluid injection is stopped, the ultrahigh pressure fluid F2 discharged from the pressure intensifier 20 accumulates in the pipe 32 and in the accumulator 31. The pressure of the working medium F1 can increase by an amount of pressure loss in the working medium circuit. This slightly increases the pressure of the fluid F2. The target pressure P1com of the working medium F1 is set to a value lower than the logical pressure PL to reduce the pressure increase when the fluid injection is stopped. With the lower target pressure P1com, the working medium pump consumes less power for maintaining the pressure. In the ultrahigh pressure area, the cylinders accommodating the plungers, as well as the discharge valve and the discharge pipe, can have large internal stress. Reducing the pressure increase during the injection stop period extends the durable life of the components of the fluid pressure producing device.

The target pressure P1com may be calculated with a method other than the above method. For example, the target pressure P1com may be 70% to 95% of the logical pressure PL. The value obtained by multiplying the target pressure P1com by the intensification ratio R may preferably be adjusted to be equal to or higher than the pressure of the fluid F2 that decreases when the moving direction of the piston 23 is switched.

When the injection is stopped, the fluid F2 accumulates between the pressure intensifier 20 and the injection valve 34. The pressure P2 of the fluid F2 thus remains unchanged unless the piston 23 moves. In contrast, the working medium F1 circulates through internal leakage in the working medium pump 11 in a closed circuit, collection from the closed circuit into the tank 17, and refilling with fresh working medium discharged from the working medium pump 11. In this case, the fluctuations in the pressure P1 occur independently of the fluctuations in the pressure P2.

The fluid pressure producing device 10 according to the present embodiment feeds back the pressure P1 when injection of the fluid F2 is stopped to maintain the pressure P1 at the target pressure P1com. This allows the pressure P1 to be constant. Under the pressure P1 deviating from its ideal value when injection of the fluid F2 is resumed, the pressure P2 can fluctuate greatly as the pressure P1 fluctuates. The fluid pressure producing device 10 according to the present embodiment maintains the pressure P1 at the target pressure P1com when injection of the fluid F2 is stopped, and thus prevents a disturbance in the pressure P2 that may otherwise occur when the injection is resumed. This generates an ideal jet with little disturbance promptly after the injection of the fluid F2 is resumed.

The maximum operation unit 42*k* operates in a period after the moving direction of the piston 23 is switched during injection of the fluid F2 to before the maximum operation unit 42*k* receives load determination information indicating 1 from the load determination unit 42*e*. In other words, the maximum operation unit 42*k* operates while the load determination information indicating 0 is being received. The maximum operation unit 42*k* controls the working medium pump 11 to discharge the working medium at a maximum flow rate based on the moving direction signal and the load determination information. More specifically, the maximum operation unit 42*k* outputs a maximum rotational speed nmax of the working medium pump 11 to the amplifier 121.

The maximum rotational speed nmax is greater than a rated rotational speed nr (described later). This shortens the time taken to resume injection of the fluid F2 from the pressure intensifier 20 after the moving direction of the piston 23 is switched. When the piston 23 starts moving after its moving direction is switched, the pressure of the working medium F1 increases as the fluid F2 is compressed. This increases the load of the working medium pump 11. The working medium pump 11 discharges the working medium F1 at the maximum flow rate until its load reaches the load limit. In this case, the working medium is discharged at the maximum flow rate for the maximum permissible time. The pressure P2 of the fluid F2 thus increases at the maximum speed.

The working medium pump 11 that is a variable displacement pump discharges the working medium at the maximum flow rate when the displacement control unit 42*d* maximizes the displacement and the maximum operation unit 42*k* generates an instruction for setting the maximum rotational speed nmax. The working medium pump 11 that is a fixed displacement pump discharges the working medium at the maximum flow rate when its rotational speed is the maximum rotational speed nmax.

The rated operation unit 42*m* controls the working medium pump 11 to discharge the working medium at a rated flow rate based on the moving direction signal and the first pressure determination signal during the injection stop period of the fluid F2. The rated operation unit 42*m* controls the working medium pump 11 to discharge the working medium at the rated flow rate based on the moving direction signal and the second pressure determination signal during injection of the fluid F2. More specifically, the rated operation unit 42*m* outputs the rated rotational speed nr of the working medium pump 11 to the amplifier 121.

When the working medium pump 11 is a variable displacement pump, the rated operation unit 42*m* transmits, in cooperation with the displacement control unit 42*d*, an instruction for setting the rotational speed corresponding to the displacement of the working medium pump 11 to the amplifier 121. As described later, the rated operation unit 42*m* may not operate during injection of the fluid F2.

The second feedback control unit 42*p* operates during injection of the fluid F2. The second feedback control unit 42*p* controls the rotational speed n of the motor 12 based on the moving direction signal, the second pressure determination signal, and the pressure P2 of the fluid F2 received from the pressure detector 33. The second feedback control unit 42*p* outputs the rotational speed n of the motor 12 to the amplifier 121.

The second feedback control unit 42*p* feeds back the pressure P2, and controls the working medium pump 11 to eliminate the difference between the target pressure P2com and the pressure P2 of the fluid F2. The feedback control may be PID control, simple adaptive control, robust control, or optimal control. The target pressure P2com is equal to the preset pressure P0 of the fluid F2.

The second feedback control unit 42*p* includes the rated filter 42*q*. The rated filter 42*q* monitors the operational conditions of the motor 12 output from the second feedback control unit 42*p* to determine whether the output of the working medium pump 11 does not deviate from the rated output range, and adjusts the rotational speed of the working medium pump 11 accordingly. The output torque of the motor 12 varies constantly. The rated filter 42*q* calculates the root mean square of the rotational torque Tr of the working medium pump 11 for a predetermined time period to yield an effective torque. The rated filter 42*q* controls the rotational speed n to prevent the effective torque from exceeding the rated torque.

The amplifier 121 may include the rated filter 42*q*.

Figure 3:
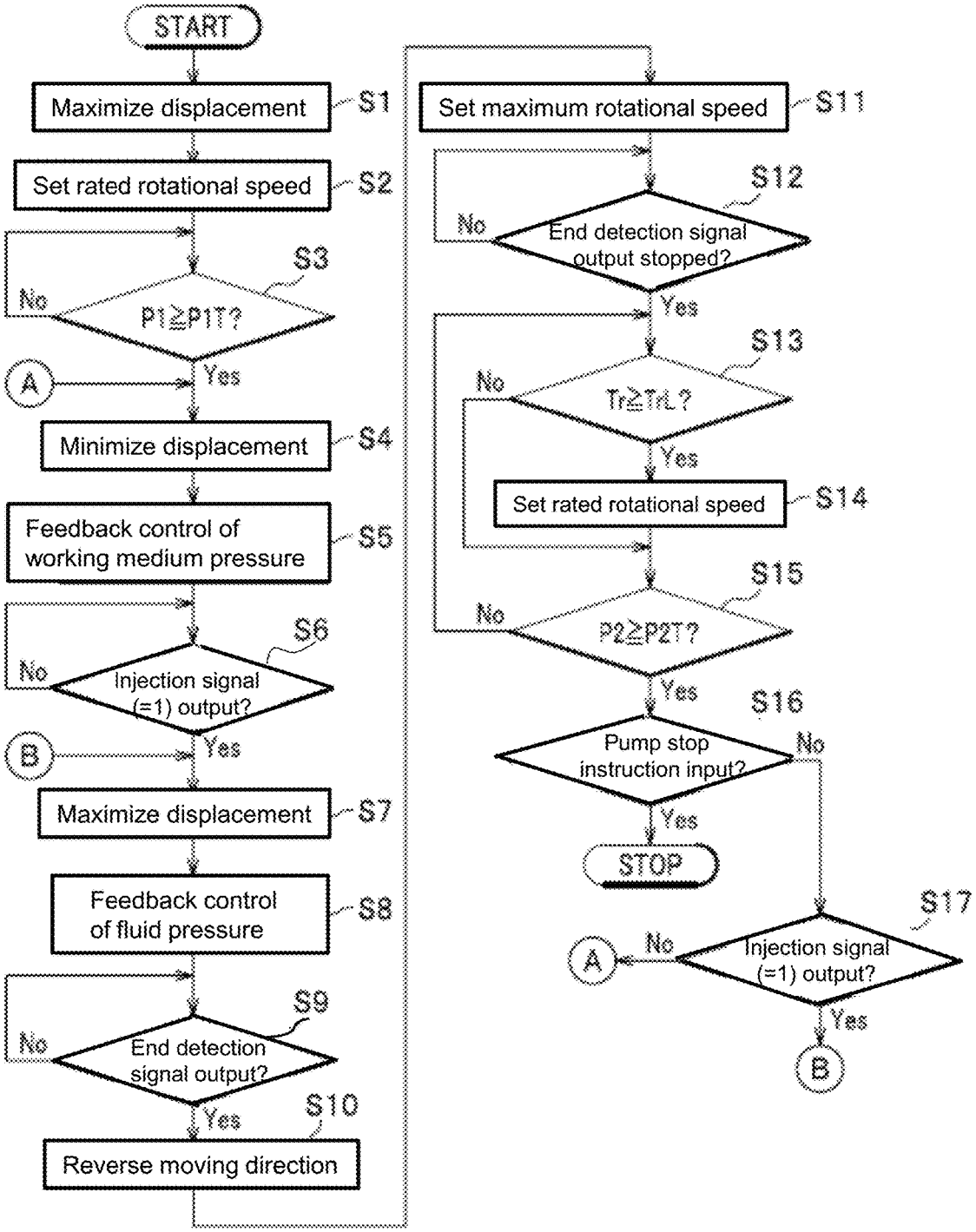
FIG. 3 is a flowchart showing a fluid pressure producing method according to the first embodiment.

A method for controlling the fluid pressure producing device 10 will now be described with reference to FIG. 3. The fluid pressure producing device 10 is activated during the injection stop period of the fluid F2 (S1 to S5). When receiving a signal for starting injection of the fluid F2, the fluid pressure producing device 10 opens the injection valve 34 and executes control intended during injection (S6 to S15). When receiving a pump stop instruction during injection of the fluid F2 (Yes in S16), the fluid pressure producing device 10 stops operating. When receiving an injection signal indicating 1 (Yes in S17), the fluid pressure producing device 10 continues its injection operation (jumps to S7). When receiving an injection signal indicating 0 (No in S17), the fluid pressure producing device 10 again enters the injection stopped state on standby (jumps to S4).

Immediately after the fluid pressure producing device 10 is activated, the displacement control unit 42*d* maximizes the displacement of the working medium pump 11 (S1).

The working medium pump 11 discharges the working medium F1 toward the inlet-outlet port 111 at a rated flow rate (S2). The rated operation unit 42*m* outputs the rated rotational speed nr to the amplifier 121. Immediately after the fluid pressure producing device 10 is activated, the rotational speed of the motor 12 is to be increased slowly.

When the working medium pump 11 starts operating, the piston 23 moves to the right under the pressure of the working medium F1. The plunger 262 compresses the fluid F2 contained in the ultrahigh pressure cylinder 252. The pressure P2 of the fluid F2 increases.

The piston 23 may move to the left immediately after activated. The moving direction of the piston 23 at the stop of the operation may be recorded. When the operation is resumed, the piston 23 may move in the recorded direction, or in the direction opposite to the recorded direction. The moving direction at the start of the operation may be selected based on the manner in which the operation is stopped. For example, the operation time after the moving direction is switched may be recorded. The operation time from when the moving direction is switched to when the operation is stopped may then be compared with the interval at which the moving direction of the piston 23 is switched. The moving direction control unit 42*a* may then determine the moving direction of the piston 23 to be used immediately after the operation is started in accordance with the position of the piston 23.

The first pressure determination unit 42*b* monitors the pressure P1 (S3). When the pressure P1 is less than the first threshold pressure P1T (No in S3), the working medium pump 11 continues its rated operation (rated rotational speed).

The condition may be whether the pressure P1 is not more than the first threshold pressure P1T, instead of whether the pressure P1 is less than the first threshold pressure P1T.

When the pressure P1 is not less than the first threshold pressure P1T (Yes in S3), the displacement control unit 42*d* minimizes the displacement of the working medium pump 11 (S4). The first feedback control unit 42*h* feeds back the pressure P1, and controls the rotational speed of the working medium pump 11 to eliminate the difference between the pressure P1 and the target pressure P1com (S5: feedback control of working medium pressure). This maintains the pressure of the working medium at the target pressure during the injection stop period, and also reduces the fluctuations in the pressure of the working medium when the injection is resumed.

In this state, the pressure intensifier 20 discharges almost no fluid F2. The working medium pump 11 discharges the working medium F1 in an amount almost equal to the total amount of the internal leakage and the flow in the collector 18. The fluid F2 discharged from the pressure intensifier 20 is not drained from the pipe 32. Thus, the pressure P2 is not lowered.

When the working medium pump 11 is a fixed displacement pump, steps S1 and S4 are eliminated.

The injection start control unit 42*c* waits for the start of injection of the fluid F2 (S6). When an instruction to start injection is input from an operation panel (not shown) into the controller 40, the injection start control unit 42*c* outputs a valve opening instruction to the injection valve 34 to open the valve. In response to this instruction, the injection valve 34 transmits a valve open signal to the injection start control unit 42*c*. The injection start control unit 42*c* then outputs an injection signal indicating 1 (Yes in S6).

When the injection valve 34 is open, the fluid F2 is jetted through the nozzle 35. The displacement control unit 42*d* maximizes the displacement of the working medium pump 11 (S7).

When the working medium pump 11 is a fixed displacement pump, step S7 is eliminated.

The second feedback control unit 42*p* subsequently feeds back the pressure P2 of the fluid F2, and controls the rotational speed of the working medium pump 11 to eliminate the difference between the pressure P2 and the target pressure P2com (S8: feedback control of fluid pressure).

This step is performed within the limit not exceeding the rated load of the working medium pump. This prevents the working medium pump from being broken by an overload. After the load of the working medium pump reaches or exceeds the load limit, feedback control is executed over the working medium pump operation to cause the pressure P2 of the fluid F2 to approach the target pressure within the permissible range of the load. This feedback control allows the pressure of the fluid to increase promptly after the moving direction of the piston is switched and to smoothly reach the target pressure, while protecting the working medium pump.

When the piston 23 reaches an end of its movement (movement end) in the drive cylinder 24, the end detector 291 or 292 transmits an end detection signal (S9). The moving direction control unit 42*a* then reverses the moving direction of the piston 23 (S10). More specifically, when the end detector 291 transmits an end detection signal, the moving direction control unit 42*a* determines the rotating direction of the working medium pump 11 to cause the working medium pump 11 to suck the working medium F1 from the second compartment 22 and discharge the medium into the first compartment 21. When the end detector 292 transmits an end detection signal, the operation reverse to this operation is performed.

When receiving an instruction indicating the reversed moving direction of the piston 23, the maximum operation unit 42*k* generates an instruction for setting the maximum rotational speed to cause the working medium pump 11 to discharge the working medium F1 at the maximum flow rate (S11).

After the rotating direction of the working medium pump 11 is reversed, the pressure in the medium compartment pressurized before the moving direction of the piston 23 is reversed (e.g., the second compartment 22 when the end detector 292 detects the piston) decreases rapidly. The piston 23 receives the pressure P2 of the pressurized fluid F2. The plunger stops promptly upon the end detection, and receives a force acting in the reversed direction of the piston 23 under the pressure P2. A typical pressure intensifier has a very large inertia, and thus has poor responsiveness to the direction switching. In the fluid pressure producing device 10 according to the present embodiment, the pressure P2 acts in the moving direction of the piston 23 after the moving direction is switched. This reduces response delays in the direction switching, and thus reduces an overshoot in the pressure P2.

The force generated by the pressure P2 acting in the reversed direction of the piston 23 also improves the performance of the working medium pump 11 for sucking the working medium F1 from the medium compartment sucked after the moving direction of the piston 23 is reversed (e.g., the first compartment 21 when the end detector 292 detects the piston).

When the working medium pump 11 starts rotating in the reversed direction, the piston 23 switches its moving direction and moves away from the movement end in the drive cylinder 24. In response to this, the end detector stops outputting an end detection signal. The moving direction control unit 42*a* then receives a signal indicating the stopped output of the end detection signal (S12).

When the working medium pump 11 continuously discharges the working medium F1 at the maximum flow rate, the plunger 261 gradually moves to the left. The pressure in the ultrahigh pressure cylinder 251 increases. As the pressure in the ultrahigh pressure cylinder 251 increases, the pressure P1 increases, and the rotational torque Tr of the input axis in the working medium pump 11 increases.

The load determination unit 42*e* monitors the rotational torque Tr of the input axis in the working medium pump 11 (S13). When the rotational torque Tr is not less than the torque limit TrL (Yes in S13), the rated operation unit 42*m* controls the rotational speed of the working medium pump 11 to discharge the working medium F1 at the rated flow rate (S14). When the rotational torque Tr is less than the torque limit TrL (No in S13), the processing advances to step S15.

The condition may be whether the rotational torque Tr exceeds the torque limit TrL, instead of whether the rotational torque Tr is not less than the torque limit TrL.

The second pressure determination unit 42*f* monitors the pressure P2 of the fluid F2 (S15). When the pressure P2 is not less than the second threshold pressure P2T (Yes in S15), the second pressure determination unit 42*f* determines whether the pump is to be stopped (S16). When the pressure P2 is less than the second threshold pressure P2T (No in S15), the processing returns to step S13.

The condition may be whether the pressure P2 exceeds the second threshold pressure P2T, instead of whether the pressure P2 is not less than the second threshold pressure P2T.

Steps S14 and S15 may be eliminated. In this case, the processing advances to step S16 when the determination result is affirmative (Yes) in step S13. The processing in step S13 is repeated when the determination result is negative (No) in step S13. In this case, the second pressure determination unit 42*f* is eliminated.

When receiving a pump stop instruction input through the operation panel (not shown), the fluid pressure producing device 10 stops operating (Yes in S16). When the fluid pressure producing device 10 stops operating, the working medium pump 11 stops rotating. The fluid F2 accumulating in the pressure intensifier 20 and the accumulator 31 is jetted through the nozzle 35. As a result, the pressure P2 of the fluid F2 gradually decreases. The working medium F1 in the circuit is collected into the tank 17 through the restrictor 153 and the leakage circuit 113. When the pressure of the working medium F1 and the pressure P2 of the fluid F2 both reach atmospheric pressure, the fluid pressure producing device 10 stops safely.

When receiving no pump stop instruction (No in S16), the controller 40 performs determination for branching in accordance with an injection signal (S17). When the output injection signal indicates 1 (Yes in S17), the processing advances to step S7. When the output injection signal indicates 0 (No in S17), the processing advances to step S4.

The fluid pressure producing device 10 according to the present embodiment produces the pressure of the fluid F2 with a smooth waveform. Moreover, the pressure waveform of the fluid F2 can have less disturbance when the injection is resumed. The fluid pressure producing device 10 thus generates a stable waterjet. The fluid pressure producing device 10 also pressurizes the fluid F2 to an ultrahigh pressure using the working medium F1 as a driving source, and thus achieves a high flow rate. The fluid pressure producing device 10 further reduces standby power consumption greatly during the injection stop period.

EXAMPLES

The driving waveform of the fluid pressure producing device 10 according to the first embodiment will now be described with reference to FIG. 4. The technical scope of the present invention is not limited to the examples described below.

The second feedback control unit 42*p* according to the present embodiment includes the rated filter 42*q*. The working medium pump 11 is a reversible, variable displacement swashplate pump. The fluid pressure producing device 10 includes the accumulator 31. The controller 40 includes the displacement control unit 42*d*. The controller 40 implements steps S1, S4, and S7 for controlling the displacement of the working medium pump 11, but does not perform the rated operation during injection of the fluid F2 (S14) and the pressure comparison of the fluid F2 (S15).

The driving waveform (behavior) of the fluid F2 during injection will now be described. The preset pressure P0 is 600 MPa.

Figure 4A:
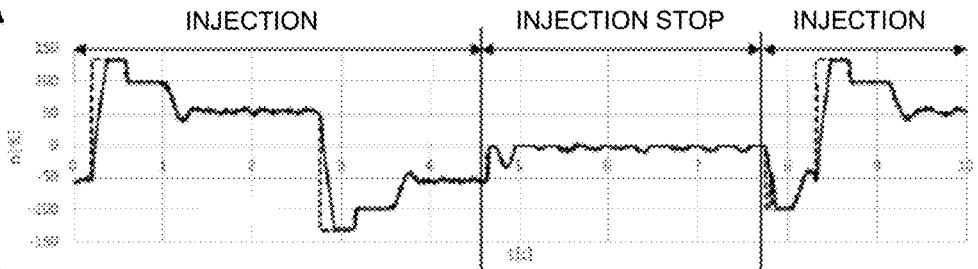
FIGS. 4A to 4D are graphs showing the driving waveform of the fluid pressure producing device according to the first embodiment.

FIG. 4A shows the relationship between the rotational speed n (%) of the working medium pump 11 and the time t (s). The rated rotational speed is assumed to be 100%. The broken line indicates a target rotational speed. The solid line indicates an actual rotational speed. Both the target rotational speed and the actual rotational speed are initially about −50%. The target rotational speed rises to 130% at t=0.25 s. The actual rotational speed starts rising slightly later and reaches the target value at t=0.3 s. The rotational speed has an inverted sign at t=0.25 s, indicating that the reversed operation is performed (S10). The rotational speed is maintained at a maximum rotational speed of 130% at t=0.3 s to 0.6 s (S11). The rotational torque Tr exceeds the torque limit TrL (Yes in S13) at t=0.6 s, and then the processing advances to the feedback control of the fluid pressure (S8). Although the second feedback control unit 42*p* continues to yield the rotational speed exceeding the rated rotational speed for a certain period of time after the processing advances to the feedback control, the rated filter 42*q* lowers the rotational speed n to the rated rotational speed. When the rotational speed nout calculated by the second feedback control unit 42*p* decreases below the rated rotational speed nr, the rotational speed gradually decreases to a substantially constant rotational speed. The rotational speed decreases below the rated rotational speed at t=1.1 s, and is substantially constant at t=1.3 s to 2.7 s, during which the piston 23 operates at a constant speed. At t=2.7 s, the end detector 291 or 292 detects the piston 23. The moving direction control unit 42*a* reverses the moving direction of the piston 23 (S10). The maximum operation unit 42*k* generates an instruction for setting the rotational speed to the maximum rotational speed of −130% in the reversed direction (S11). The waveform in the reversed operation changes in the same manner as described above.

Figure 4B:
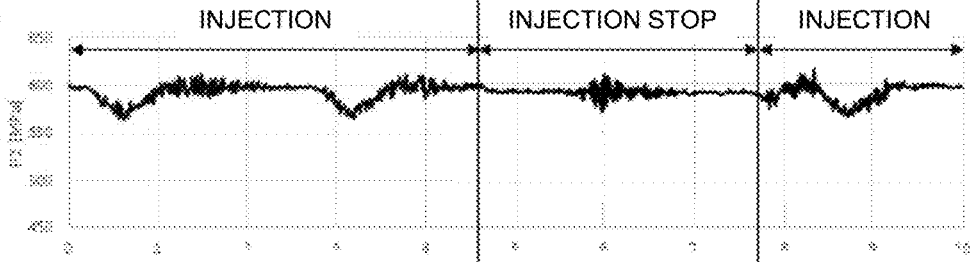

FIG. 4B shows the relationship between the pressure P2 (MPa) of the fluid F2 and the time t (s). The pressure P2 decreases temporarily at t=0.25 s, at which the moving direction of the piston 23 is reversed, and then increases at t=0.7 s again. As the fluid F2 accumulating in the accumulator 31 is discharged, the pressure fluctuations undergo smooth changes as if they are plotted with moving averages. This reduces the pressure decrease. The pressure P2 decreases only to 570 MPa, which is 95% of the preset pressure P0. At t=1.1 s, the rotational speed of the working medium pump 11 starts decreasing gradually from the rated rotational speed, and the pressure P2 reaches the preset pressure P0=600 MPa. At this timing, the fluid is supplied to the accumulator 31 to increase the pressure.

In the opposite way, the pressure P2 reaches the preset pressure P0, at which the moving speed of the piston 23 decreases to a value obtained by dividing the injection flow rate of the fluid F2 by the cross sectional area of the ultrahigh pressure cylinders 251 and 252. This is reflected in the behavior of the rotational speed n of the working medium pump 11 shown in FIG. 4A. The pressure P2 is maintained substantially at the preset pressure P0=600 MPa at t=1.1 s to 2.7 s. Almost no overshoot is observed in the pressure P2. The pressure P2 produced by the fluid pressure producing device 10 according to the present embodiment has a stable pressure waveform with high reliability.

Figure 4C:
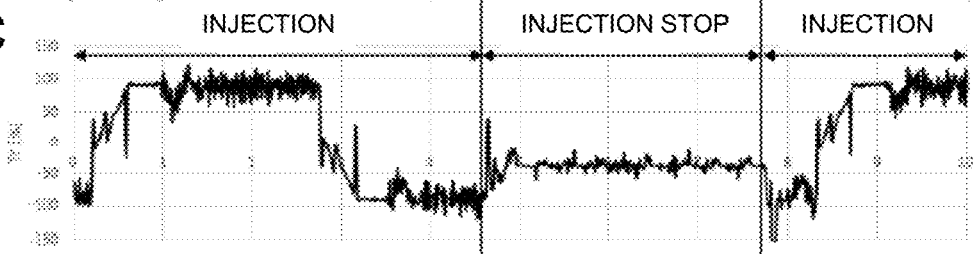

FIG. 4C shows the relationship between the rotational torque Tr (%) of the input shaft in the working medium pump 11 and the time t (s). The rated torque is assumed to be 100%. The rotational torque Tr fluctuates at around −100% at t=0 s to 0.25 s. When the moving direction of the piston 23 is reversed (t=0.25 s), the absolute value of the rotational torque Tr decreases rapidly. The rotational torque Tr then has an inverted sign and rapidly increases toward the time t=0.7 s, at which the pressure P2 starts increasing again. When the pressure P2 turns to increase (t=1.4 s), the rotational torque Tr is regulated by the rated filter 42*q* at about 90%, which is near the rated value. After the rotational speed n of the working medium pump 11 starts decreasing (t=1.1 s), the rotational torque Tr oscillates at around 100% of the rated torque. After the moving direction of the piston 23 is reversed (t=2.7 s), the rotational torque Tr changes in the same manner as described above.

Figure 4D:
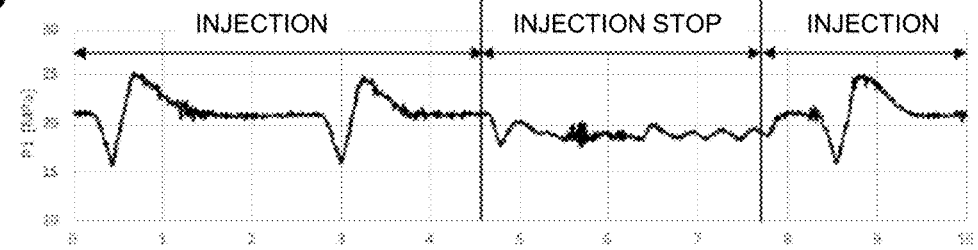

FIG. 4D shows the relationship between the pressure P1 (MPa) and the time t (s). When the rotating direction of the working medium pump 11 is reversed (t=0.25 s), the pressure P1 decreases temporarily. After the rotating direction of the working medium pump 11 is reversed, the pressure continues to decrease for a certain period of time. The pressure P1 fluctuates at around 22 MPa. The pressure P1 turns to increase at t=0.4 s, which is immediately before the time t=0.6 s when the pressure P2 turns to increase. The pressure P1 reaches its peak (t=0.7 s) slightly after the rotational torque Tr reaches the torque limit TrL (t=0.6 s). The pressure P1 stops decreasing slightly after t=1.2 s, at which the rotational speed n of the working medium pump 11 reaches the rated value. The pressure P1 remains at around the rated value of 22 MPa from when t=1.5 s until the moving direction of the piston 23 is reversed. This pressure is the logical pressure PL. After the moving direction of the piston 23 is reversed (t=2.7 s), the pressure P1 changes in the same manner as described above.

The driving waveform of the fluid F2 during the injection stop period will now be described.

In response to an instruction for stopping injection input at t=4.7 s, the injection start control unit 42*c* closes the injection valve 34. The displacement control unit 42*d* minimizes the displacement of the working medium pump 11. The first feedback control unit 42*h* feeds back the pressure P1, and controls the rotational speed n of the working medium pump 11 to eliminate the difference between the pressure P1 and the target pressure P1com.

As shown in FIG. 4A, the rotational speed n of the working medium pump 11 promptly approaches 0 after the injection of the fluid F2 is stopped. The rotational speed n is minimized to provide a discharge amount corresponding to the total amount of the internal leakage in the working medium pump 11 and the collected flow in the collector 18.

As shown in FIG. 4B, the pressure P2 of the fluid F2 is maintained at 580 MPa, which is slightly lower than the preset pressure P0 (=600 MPa). The lower pressure P2 seemingly results from different response times taken for the displacement lowered by the displacement control unit 42*d* and for the speed lowered by the pressure intensifier 20.

As shown in FIG. 4C, the rotational torque Tr of the input axis in the working medium pump 11 also rapidly decreases as the rotational speed n of the working medium pump 11 decreases. The rotational torque Tr approaches 0% to minimize power consumption. The power consumption during the injection stop period of the fluid F2 (not shown) is reduced to about 8% of the power consumption at the peak during injection (when the moving direction of the piston 23 is reversed).

As shown in FIG. 4D, the pressure P1 slightly decreases but is maintained at about 17 MPa, which is slightly lower than the logical pressure PL. This pressure is higher than 16 MPa, at which the moving direction of the piston 23 is reversed. The pressure P1 is maintained high through the feedback control. Thus, the pressure P2 of the fluid F2 increases promptly when the injection is resumed.

Finally, the driving waveform of the fluid F2 when the injection is resumed will be described.

When the injection of the fluid F2 is resumed (t=7.75 s), the piston 23 moves in the same direction as used immediately before the injection is stopped. The waveforms showing the rotational speed (FIG. 4A), the pressure of the fluid F2 (FIG. 4B), the rotational torque (FIG. 4C), and the pressure of the working medium F1 (FIG. 4D) are all substantially the same as those waveforms observed in the reversed moving direction.

In the present embodiment, the pressure waveforms indicating the fluid and the working medium both show small fluctuations. These waveforms also have less disturbance before and after the injection is stopped and resumed. A waterjet apparatus including the fluid pressure producing device according to the present embodiment thus has a very small disturbance in the jet during injection, as well as when the injection is resumed.

During the injection stop period, the rotational speed n of the working medium pump 11 and the rotational torque Tr of the motor 12 are very low. This clearly shows high energy efficiency.

Second Embodiment

Although the first embodiment describes the fluid pressure producing device 10 for a closed circuit, the present invention is also applicable to a fluid pressure producing device 70 for an open circuit. The fluid pressure producing device 70 according to a second embodiment will now be described. The components, functions, and steps that are the same as in the first embodiment are given the same reference numerals as those, and will not be described in detail.

Figure 5:
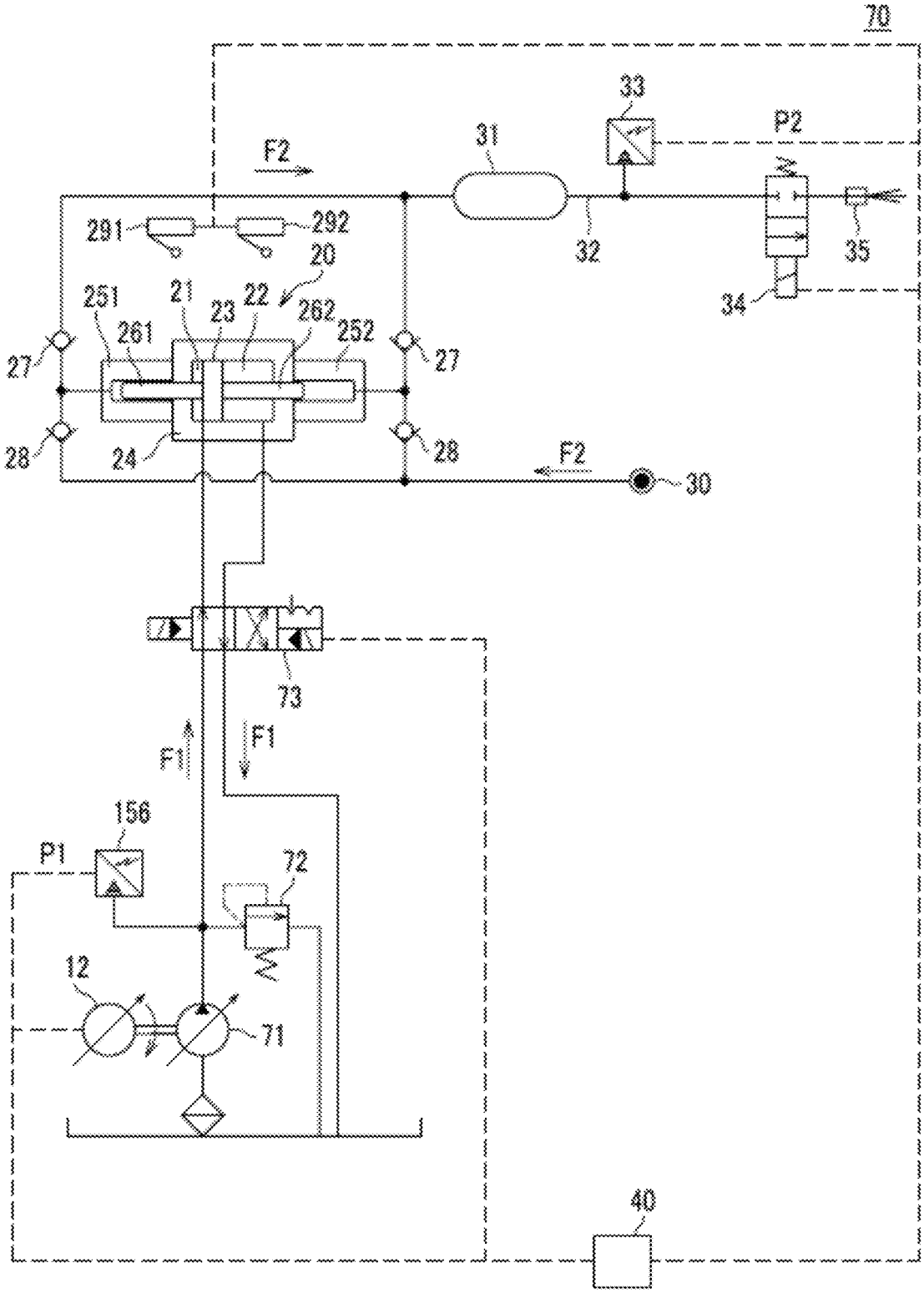
FIG. 5 is a schematic diagram of a fluid pressure producing device according to a second embodiment.

FIG. 5 is a circuit diagram of the fluid pressure producing device 70 according to the present embodiment. A working medium pump 71 is used for an open circuit. The working medium pump 71 is a displacement pump, such as a variable displacement pump or a fixed displacement pump. The working medium pump 71 is driven by a motor 12. The motor 12 is a servo motor. The motor 12 rotates in one direction of the working medium pump 71. The working medium pump 71 includes a leak valve 72 at its discharge port. The leak valve 72 protects the working medium circuit from a rapid pressure increase. A channel switch valve 73 switches the moving direction of a piston 23. A pressure detector 156 detects the pressure P1 of the working medium F1. A controller 40 controls the motor 12 and a channel switch valve 73 based on signals from end detectors 291 and 292, and the pressure detectors 156 and 33. The other components of the fluid pressure producing device 70 for an open circuit are known and will not be described in detail.

Figure 6:
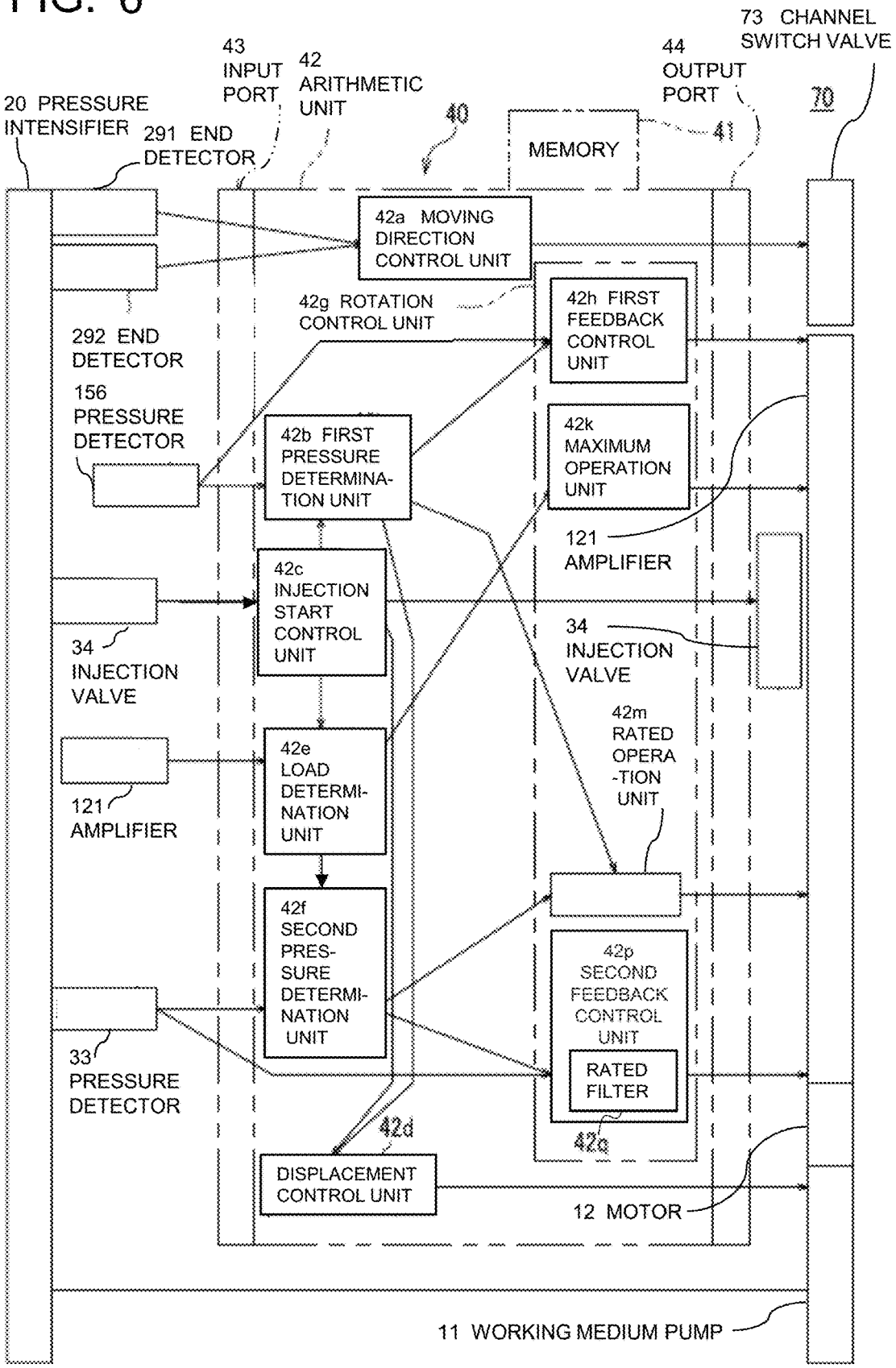
FIG. 6 is a functional block diagram of a fluid pressure producing device according to the second embodiment.

FIG. 6 is a functional block diagram of the fluid pressure producing device 70. A moving direction control unit 42*a* switches a channel switch valve 73 based on a signal from the end detector 291 or 292. A rotation control unit 42*g* rotates the motor 12 in one direction, and thus receives no signal from the moving direction control unit 42*a*.

The fluid pressure producing device 70 for an open circuit according to the present embodiment controls the pressure P2 of the fluid F2 in a stable manner.

REFERENCE SIGNS LIST

10, 70 fluid pressure producing device
11, 71 working medium pump
12 motor
156 pressure detector (working medium pressure detector)
20 pressure intensifier
23 piston
24 drive cylinder (first cylinder)
251, 252 ultrahigh pressure cylinder (second cylinder)
261, 262 plunger
291, 292 end detector
33 pressure detector (fluid pressure detector)
34 injection valve
40 controller
41 memory
42 arithmetic unit
42*a* moving direction control unit
42*b* first pressure determination unit
42*c* injection start control unit
42*d* displacement control unit
42*e* load determination unit
42*f* second pressure determination unit (pressure determination unit)
42*h* first feedback control unit (working medium pressure feedback control unit)
42*k* maximum operation unit
42*m* rated operation unit
42*p* second feedback control unit (fluid pressure feedback control unit)

42*g* rotation control unit
43 input port
44 output port
F1 working medium
F2 fluid
n rotational speed
nmax maximum rotational speed
nr rated rotational speed
P0 preset pressure
P1 pressure of working medium F1
P1com target pressure of working medium F1
P1T first threshold pressure
P2 pressure of fluid F2
P2com target pressure of fluid F2
P2T second threshold pressure (threshold pressure)
PL logical pressure
R intensification ratio
Tr rotational torque (load)
TrL torque limit (load limit)

What is claimed is:

1. A fluid pressure producing method for pressuring a fluid using a plunger driven by operating a double-acting piston with a pressure of a working medium produced from a working medium pump, the method comprising:

switching a moving direction of the piston when detecting the piston reaches a movement end;

detecting a load of the working medium pump and determining whether the detected load is not less than a load limit;

operating the working medium pump to discharge the working medium at a maximum flow rate while the load is less than the load limit after the moving direction of the piston is switched;

detecting a pressure of the fluid and feeding back the detected pressure of the fluid and performing feedback control of the pressure of the fluid to eliminate a difference between the pressure of the fluid and a target pressure of the fluid;

operating the working medium pump to discharge the working medium at a rated flow rate after the load reaches or exceeds the load limit; and determining whether the detected pressure of the fluid is not less than a threshold pressure that is 80% to 97% of the target pressure of the fluid to perform the feedback control of the pressure of the fluid after the pressure of the fluid reaches or exceeds the threshold pressure.

2. The fluid pressure producing method according to claim 1, wherein the feedback control of the pressure of the fluid is performed after the load reaches or exceeds the load limit, and the feedback control of the pressure of the fluid includes controlling the load in a manner not to exceed a rated load of the working medium pump.

3. The fluid pressure producing method according to claim 2, wherein the load is a rotational torque of an input axis included in the working medium pump.

4. The fluid pressure producing method according to claim 2, further comprising:

detecting a pressure of the working medium and feeding back the detected pressure of the working medium and performing feedback control of the pressure of the working medium to eliminate a difference between the pressure of the working medium and a target pressure of the working medium when injection of the fluid is stopped.

5. The fluid pressure producing method according to claim 2, wherein the working medium pump is a variable displacement pump, the method further comprising:

maximizing a displacement of the working medium pump when injection of the fluid is started; and minimizing the displacement of the working medium pump when injection of the fluid is stopped.

6. The fluid pressure producing method according to claim 1, wherein the load is a rotational torque of an input axis included in the working medium pump.

7. The fluid pressure producing method according to claim 6, further comprising:

detecting a pressure of the working medium and feeding back the detected pressure of the working medium and performing feedback control of the pressure of the working medium to eliminate a difference between the pressure of the working medium and a target pressure of the working medium when injection of the fluid is stopped.

8. The fluid pressure producing method according to claim 6, wherein the working medium pump is a variable displacement pump, the method further comprising:

maximizing a displacement of the working medium pump when injection of the fluid is started; and minimizing the displacement of the working medium pump when injection of the fluid is stopped.

9. The fluid pressure producing method according to claim 1, further comprising:

detecting a pressure of the working medium and feeding back the detected pressure of the working medium and performing feedback control of the pressure of the working medium to eliminate a difference between the pressure of the working medium and a target pressure of the working medium when injection of the fluid is stopped.

10. The fluid pressure producing method according to claim 9, wherein the target pressure of the working medium is lower than a pressure obtained by dividing the target pressure of the fluid by an intensification ratio that is a ratio of a pressure receiving area of the piston and a pressure receiving area of the plunger.

11. The fluid pressure producing method according to claim 9, wherein the working medium pump is a variable displacement pump, the method further comprising:

maximizing a displacement of the working medium pump when injection of the fluid is started; and minimizing the displacement of the working medium pump when injection of the fluid is stopped.

12. The fluid pressure producing method according to claim 1, wherein the working medium pump is a variable displacement pump, the method further comprising:

maximizing a displacement of the working medium pump when injection of the fluid is started; and minimizing the displacement of the working medium pump when injection of the fluid is stopped.

13. A fluid pressure producing device, comprising:

a working medium pump configured to pressurize a working medium;

a piston configured to reciprocate in a first cylinder with the pressurized working medium;

a plunger connected to the piston and configured to reciprocate in a second cylinder to pressurize a fluid;

an end detector configured to detect the piston reaching a movement end;

a fluid pressure detector configured to detect a pressure of the fluid; and a controller including a moving direction control unit configured to determine a moving direction of the piston based on a result of detection performed by the end detector, a load determination unit configured to determine whether a load of the working medium pump is not less than a load limit, a maximum operation unit configured to operate the working medium pump to discharge the working medium at a maximum flow rate while the load determination unit determines that the load is less than the load limit after the moving direction control unit switches the moving direction of the piston, a fluid pressure feedback control unit configured to feed back the pressure of the fluid detected by the fluid pressure detector, and perform feedback control of the pressure of the fluid to eliminate a difference between the pressure of the fluid and a target pressure of the fluid, a rated operation unit configured to control the working medium pump to discharge the working medium at a rated flow rate, and a pressure determination unit configured to determine whether the detected pressure of the fluid is not less than a threshold pressure that is 80% to 97% of a target pressure of the fluid, wherein the controller is configured to operate the working medium pump to discharge the working medium at the rated flow rate after the load reaches or exceeds the load limit, and operate the fluid pressure feedback control unit to perform feedback control of the pressure of the fluid, based on a determination that the detected pressure of the fluid is not less than the threshold pressure, to eliminate a difference between the pressure of the fluid and a target pressure of the fluid after the pressure of the fluid reaches or exceeds the threshold pressure.

14. The fluid pressure producing device according to claim 13, further comprising:

a working medium pressure detector configured to detect a pressure of the working medium; and an injection valve configured to start and stop injection of the fluid, wherein the controller further includes a working medium pressure feedback control unit configured to feed back the pressure of the working medium detected by the working medium pressure detector, and control the pressure of the working medium to eliminate a difference between the pressure of the working medium and a target pressure of the working medium.

* * * * *